US006506075B2

(12) United States Patent
Chiran et al.

(10) Patent No.: US 6,506,075 B2
(45) Date of Patent: Jan. 14, 2003

(54) ANGLE TYPE PLUG CONNECTOR

(75) Inventors: Kiyohiko Chiran, Takarazuka (JP); Takashi Suyama, Amagasaki (JP); Terumi Nakashima, Takatsuki (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/854,687

(22) Filed: May 15, 2001

(65) Prior Publication Data

US 2001/0049225 A1 Dec. 6, 2001

(30) Foreign Application Priority Data

May 24, 2000 (JP) ..... 2000-152568

(51) Int. Cl.[7] ..... H01R 13/648
(52) U.S. Cl. ..... 439/607; 439/696; 439/610
(58) Field of Search ..... 439/607–610, 439/694, 701, 686, 696

(56) References Cited

U.S. PATENT DOCUMENTS 4,306,760 A * 12/1981 Testa ..... 439/610
4,386,819 A * 6/1983 Asick et al. ..... 439/610
4,398,780 A * 8/1983 Novotny et al. ..... 439/610
4,838,808 A * 6/1989 Kujiura ..... 439/357
4,964,815 A * 10/1990 Kawai et al. ..... 439/610

* cited by examiner

*Primary Examiner*—Hian Vu
(74) *Attorney, Agent, or Firm*—Antonelli, Terry, Stout & Kraus, LLP

(57) ABSTRACT

An angle type plug connector 1 has an insulated body 2 for insertion into a mating connector, and contacts 3 fixed in the insulated body and each having at its one end a finger 9 for contact with a foreign contact held in the mating connector, each contact having at its other end a leg 10 adjoined to one electric wire 36 in a signal transmission cable 35. The connector also has an angle type shield 32 consisting of a pair of first and second metallic covers, the first cover 4 enclosing outer portions of the insulated body 2, and the second cover 5 enclosing the contacts' legs 10 and the wires' bare end portions, so that the second cover extends at a right angle relative to the first cover. An insulated housing encloses the shield such that the insulated body 2 and the cable 35 protrude from the housing and at a right angle to each other, and the housing is split up into a first and second halves 6 and 7 so that these halves extend along a plane that includes the axis of the insulated body and the central line of the cable, the split halves having faces fitted one on another. Retention grooves formed in these faces secure in them guard lugs of the insulated body, and each half 6 and 7 has three side walls around the shield 32 and three interlocking portions 26–31 formed in and along the side walls, so that a narrower space will suffice in putting the connector in and out of the mating connector so as to increase freedom of handling the cables and match it to various surroundings, rendering it more resistant to a distorting or withdrawing stress imparted to the cable.

7 Claims, 5 Drawing Sheets

ANGLE TYPE PLUG CONNECTOR

FIELD OF THE INVENTION

The present invention relates to an electric connector that is adapted for attachment to a high-frequency transmission cable so as to be disposed between some electronics apparatuses or incorporated in the internal wiring within a single electronics apparatus, and more particularly relates to an angle type plug connector shielded with anti-noise metallic covers.

PRIOR ART

The current standard 'IEEE-1394' prescribes only certain straight type plug connectors 42 as shown in FIG. 5. On the other hands, some types of angle type plug connectors 51 are known in the art as illustrated in FIG. 6, wherein split halves 52 and 53 of a cover housing do extend perpendicularly to the axis of the plug 54. Thus, the axis of a signal transmission cable 35 lies in parallel with planes that respectively include the longitudinal center lines of inner and outer halves of this cover housing.

A mating connector 41 built in an electronics apparatus 40 will be coupled with the straight type plug connector 42 in a manner as seen in FIG. 5. Such a connection needs a considerably large space in the direction in which that plug connector 42 will be pulled in or removed from the mating connector 41. An apparatus wall 43 or the like obstacle has, however, often restricted such a space so that the cable 35 extending from the plug connector 42 was likely to be forcibly bent, bringing about breakage of internal conductive wires. The bending and/or deflection of the cable 35 in many directions have often caused the connector 42 to be wrenched or distorted in position or pulled off.

Also in the other case of the prior art angle type connector 51 shown in FIG. 6, there has been a similar problem. Only the inner one of split halves 52 of the cover housing was secured to the plug 54, thus causing a poorer resistance against distortion of that housing's outer half 53 not directly adjoined to said plug.

SUMMARY OF THE INVENTION

The present invention was made in view of the drawbacks inherent in the prior art structure. An object of the invention is therefore to provide an angle type plug connector that can be thrust into and away from a mating connector within a narrower space, such that its cable can more freely be bent in any desired direction to thereby improve it in adaptation to its surroundings. This connector provided herein has to be so rigid as to withstand distortion and/or to resist any withdrawing stress even if and when its cable would occasionally be bent or turned in use.

In order to achieve the objects set forth above, the present invention provides an angle type plug connector that comprises an insulated body having an axis and an outer end portion that is designed for insertion into a mating connector, the insulated body having an inner end region integral with guard lugs protruding perpendicularly to the axis. Incorporated in the angle type plug connector are a plurality of contacts fixed in the insulated body and each having at one of its opposite ends a finger to be kept in touch with a foreign contact held in the mating connector, each contact also having at the other end thereof a leg adjoined to one of electric wires constituting a signal transmission cable that has a central line. The plug connector still further comprises an angle type shield that consists of a first metallic cover and a second metallic cover, the first metallic cover enclosing outer portions of the insulated body, and the second cover enclosing the legs of the contacts and bare end portions of the electric wires, wherein the second metallic cover extends generally at a right angle relative to the first cover. The plug connector yet still further comprises an insulated housing that encloses the angle type shield such that the insulated body and the signal transmission cable protrude from the housing and perpendicularly to each other. The angle type plug connector is further characterized in that the insulated housing is split up into a first half and a second half symmetrical therewith so that these halves lie in parallel with a plane in which the axis of the insulated body and the central line of the signal transmission cable are included. The split halves of the insulated housing respectively have inner faces fitted one on another, such that retention grooves formed in these inner faces do secure therein the guard lugs of the insulated body, and each of the split halves has three side walls extending generally around the angle type shield and has three interlocking portions each formed in and along the respective side walls.

The first metallic cover constituting the angle type shield is composed of a forward cylindrical part enclosing the transversely protruding insulated body, and a middle part that is generally U-shaped in cross section to have side walls, continues from an inner end of the forward cylindrical part and extends downwards perpendicularly thereto. The first cover further has a collar portion continuing from a lower end of the middle part so as to grip a shielding layer of the signal transmission cable. The second metallic cover comprises a main part generally U-shaped in cross section to have side walls and a rear wall, with the side walls thereby engaging with the middle part of the first metallic cover so as to form a rectangular cylinder. The second cover further has a top plate that is an upward extension of the rear wall, with the extension being bent forwards to be juxtaposed to an inner end of the forward cylindrical part of the first cover so as to close an upper end opening of the rectangular cylinder, whereby the middle and main parts (both U-shaped) do cooperate with the top plate to provide a box-shaped compartment enclosing the bare wire ends and the contact legs.

Preferably, the side walls of the main U-shaped part may partially overlap and engage the corresponding side walls of the middle U-shaped part so as to rigidify the rectangular cylinder.

Also preferably, both the split halves of the insulated housing may have integral supports protruding transversely from upper ends of said halves. In this case, the retention grooves will be disposed in the integral supports so that the insulated body enclosed in the first metallic cover does protrude transversely from these supports.

THE PREFERRED EMBODIMENTS

Figure 1:
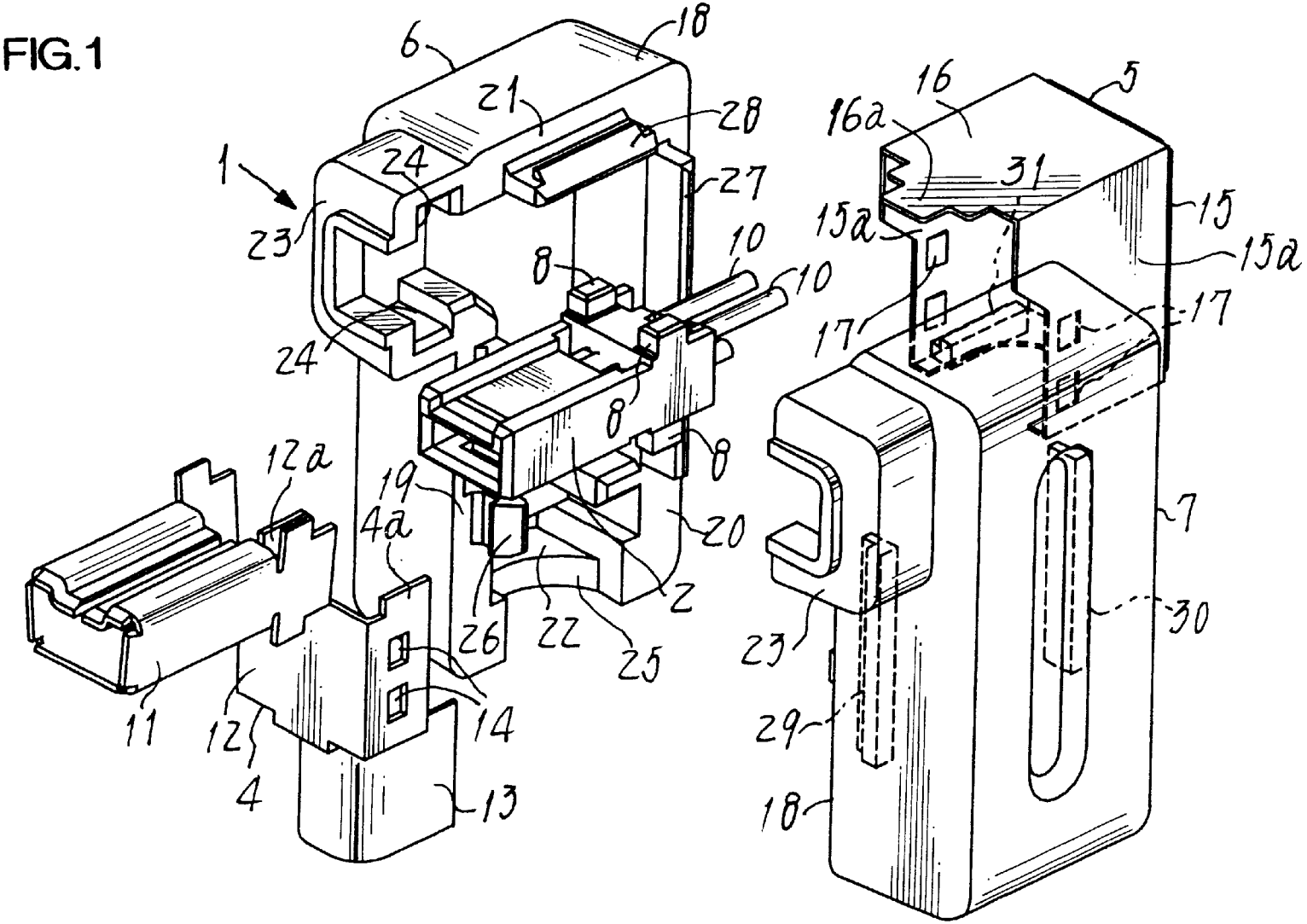
FIG. 1 is an exploded perspective view of an angle type plug connector provided in an embodiment of the present invention.

Now some embodiments of the present invention will be described referring to the drawings.

FIG. 1 shows an angle type plug connector 1 of the invention shown in its exploded state. This connector 1 comprises, as a principal member thereof, an insulated body 2 whose forward end is to be inserted into a mating connector 41 (see FIG. 4). A plurality of contacts 3 (see FIG. 3) are incorporated in the insulated body 2, an angle type shield consisting of metallic covers 4 and 5 and an insulated housing split up into halves 6 and 7 do also constitute the present connector.

Figure 2:
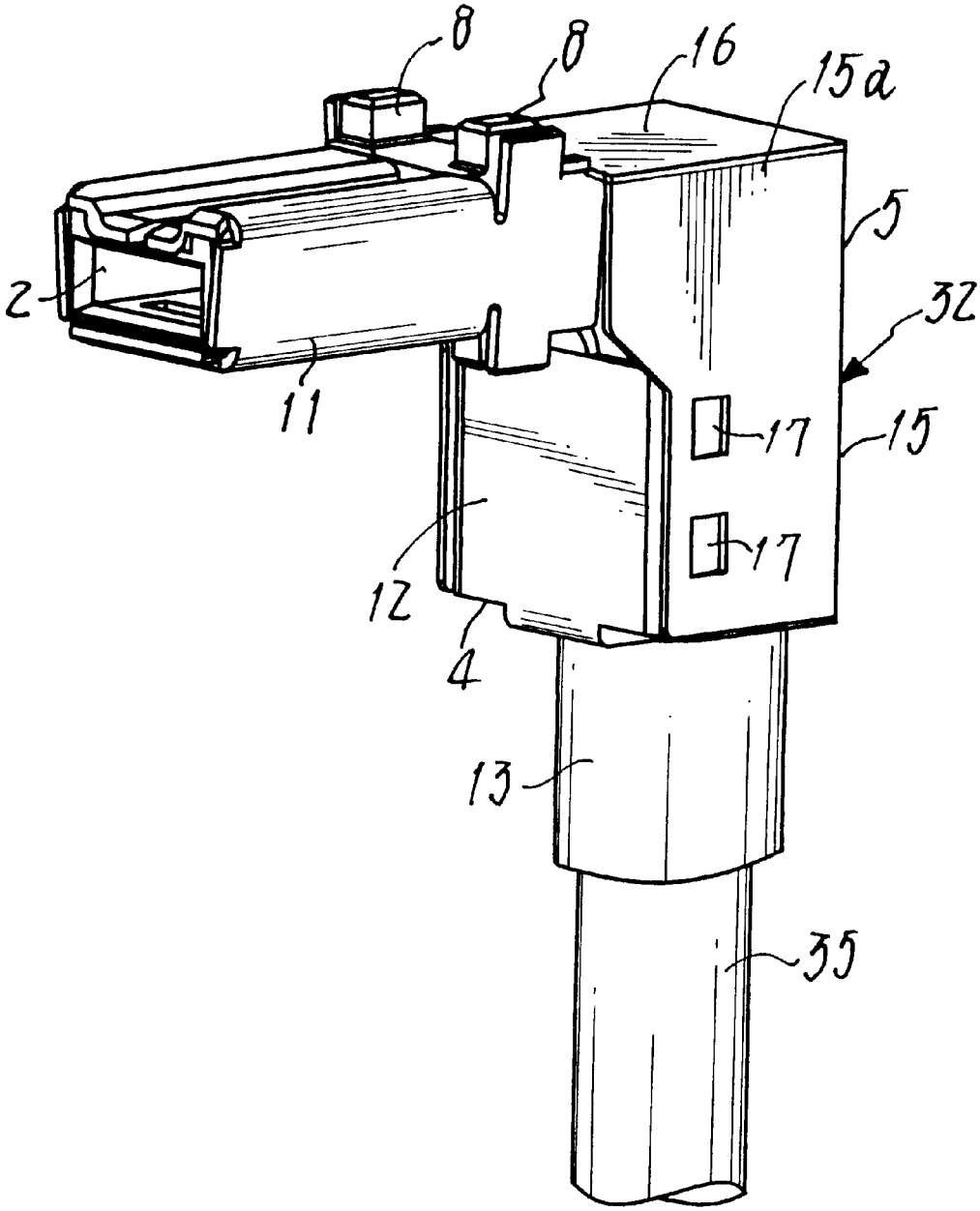
FIG. 2 is a perspective view of an assembly of a main body of the connector and a signal transmission cable connected thereto, with an angle type shield consisting of metallic covers being attached to the main body.
Figure 3:
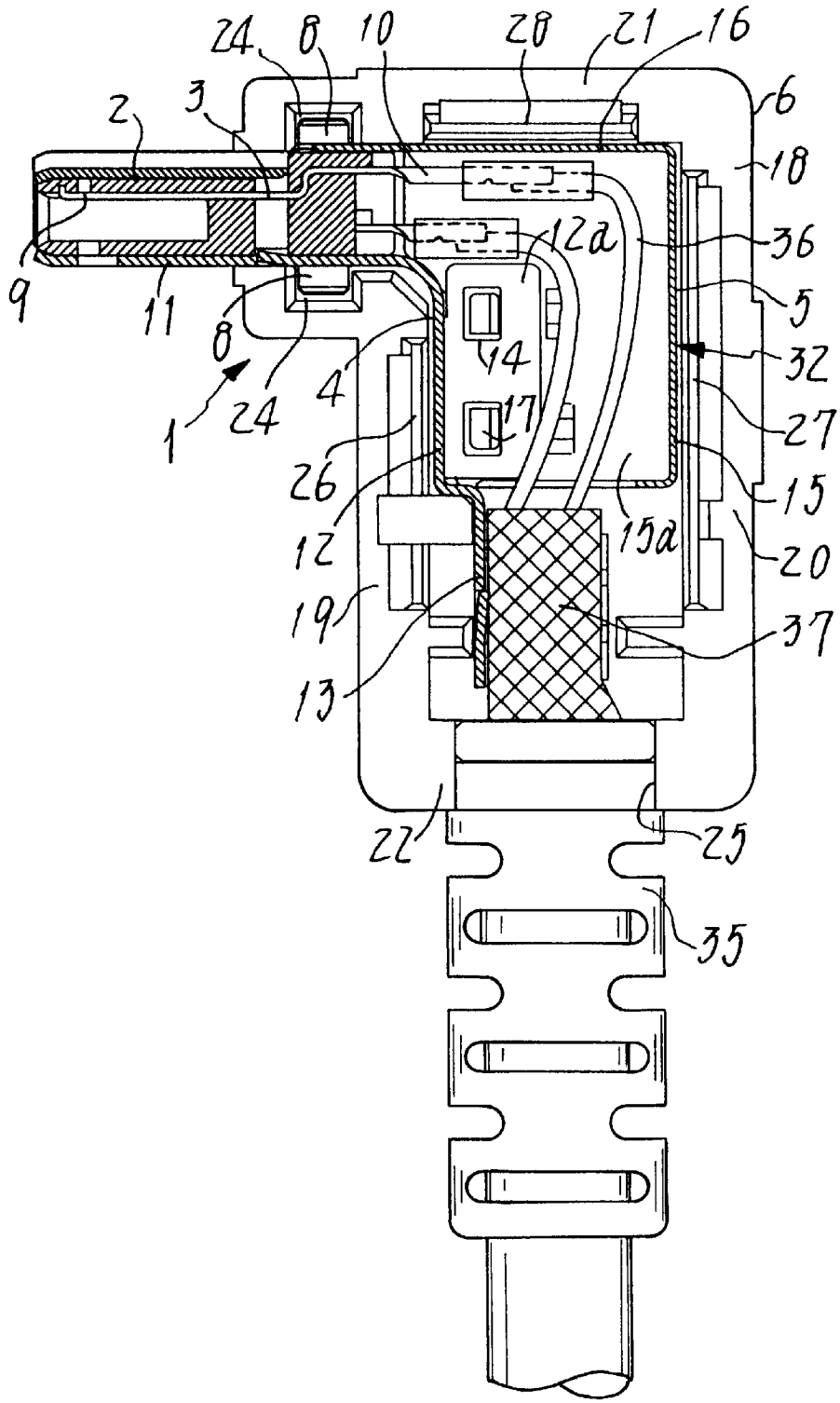
FIG. 3 is a front elevation of the assembly shown in FIG. 2 and enclosed in an insulated housing to give a finished plug connector, with principal parts thereof being shown in vertical cross section.

The insulated body 2 is a rectangularly cylindrical piece made of an insulating plastics. Guard lugs 8 are formed respectively integral with four inner corners of the insulated body 2. Each contact 3 is made by pressing a thin metal plate and insert-molded in said body and has opposite ends as seen in FIG. 3. A finger 9 formed as one of the opposite ends and extending to the proximity of the forward end of the insulated body 2 is intended to electrically touch a mating contact (not shown) of the mating connector 41. The other end of each contact 3 extends rearwards from the inner end of said body 2 is formed as a leg 10 to be fitted on one of wires 36 constituting a signal transmission cable 35. Each of the metallic covers 4 and 5 and the angle type shield is made by pressing a thin metal sheet. One of those metallic covers, i.e., the first cover 4 has a forward cylindrical part 11 enclosing the insulated body 2, and a middle part 12 U-shaped in cross section and extending down at a right angle from the inner end of the cylindrical part. The metallic cover 4 further has a collar portion 13 continuing from the lower end of the U- shaped middle part 12 so as to grip the shielding layer 37 of the cable 35. The facing side walls 12*a* and 12*a* has slots 14 serving to secure the other metallic cover, i.e., the second cover 5 as will be detailed below. On the other hand, the second metallic cover 5 has a main part 15 U- shaped in cross section so as to engage with the also U-shaped middle part 12 of the first cover 4. to thereby provide a shielding rectangular cylinder 32 (see FIG. 2). A top plate 16 extending from and bent at the upper end of the U-shaped main part 15 does close an upper end opening of said rectangular cylinder 32. A forward extension 16*a* of the top plate 16 will be disposed at the proximity of the inner end of the forward cylindrical part 11 enclosing the insulated body 2, when the first and second metallic covers united together. Thus, the body's 2 inner and upper portion exposed from the cylindrical part 11 will be covered with such a forward extension 16*a*. The facing side walls 15*a* and 15*a* have protrusions 17 that are portions thereof pressed outwards therefrom so as to fit in the respective slots 14 formed in the first cover 4.

The split halves 6 and 7 of the insulated housing are formed of an insulating plastics, so that when assembled, they will take their position along a plane which includes the axis of the insulated body 2 and the center line of the signal cable 36. A main body 18 of each of those split halves 6 or 7 is box-shaped such that its side walls 19 and 20, its top wall 21 and its bottom wall 22 do define a cavity between them. This cavity has an opening facing another opening formed in the main body of the other half 7 or 6. An integral support 23 protrudes transversely from the upper end of one such side wall 19 of each split half. Retention grooves 24 are thus formed in those integral supports 23 in order to receive therein the inner end of insulated body 2 and the guard lugs 8. Further, each split half of the insulated housing has in its bottom 22 a semicircular cutout 25 for gripping the signal transmission cable 35.

The split halves 6 and 7 have, in common, the structural features as described above, though there is observed a difference between them due to certain interlocking means that are formed in end faces thereof facing one another. In detail, the first half 6 of the housing has three interlocking protrusions 26, 27 and 28 on and along the end faces of its side walls 19, 20 and top wall 21. Correspondingly, the other half 7 of the housing has in and along its end faces three tight grooves 29, 30 and 31 to receive those protrusions that will be snapped therein.

As shown in FIG. 3, the angle type plug connector 1 of the structure discussed above and proposed herein may be used in connection with the signal cable 35 on which the connector is mounted. In this case, the wire ends 36 in the cable will be crimped on or soldered to the contact legs 10 that protrude rearwardly of the insulated body 2. Next, the shielding layer 37 will be gripped by the collar portion 13, after inserting therein the cable end 35 with this layer through the first metallic cover 4 fitted on the insulated body. In this state of the members, this body 2 takes its position perpendicular to the signal transmission cable 35. Thereafter, the U-shaped main part 15 of second metallic cover 5 will be put on the U-shaped middle part 12 of first cover 4, such that the former part has its side walls 15*a* overlapping the side walls 4*a* of the latter part. Such a subassembly of those covers 4 and 5 is fixed by engaging the protrusions 17 with the slots 14, thus finishing the shielding rectangular cylinder 32. As will be best seen in FIG. 2, this cylinder 32 encloses well both the inner end of insulated body 2 and the wires' 36 bare end portions not seized with the connection legs 10. In this manner, an excellent shielding effect is afforded for those end and portions. Further, the first cover's 4 U-shaped part 12 is now firmly engaged with the second cover's 5 U-shaped part 15 facing and overlapping the former part. This structure has an excellent rigidity such that the connector's core can withstand any intensive stress that might be caused by distortion or a pulling force imparted to the cable.

Subsequent to arrangement of those members in this manner, the insulated body 2 having the contacts 3 accommodated therein will be hold at a right angle relative to the signal cable 35. This subassembly enclosed with the first and second metallic covers 4 and 5 will be placed in the box-shaped main body 18 of the housing's first half 6. The inner end of the insulated body 2 with the guard lugs 8 thus fits in the groove 24 of integral support 23 so that this body protrudes transversely, with the cable 35 fitted in the cutout 25 trailing down. Next, the interlocking protrusions 26, 27 and 28 will be snapped in the tight grooves 29, 30 and 31 that are formed in the housing's second half 7. In this way, the shielding rectangular cylinder 32 is gripped by and between the split halves 6 and 7 of insulated housing to give a finished angle type plug connector.

Figure 4:
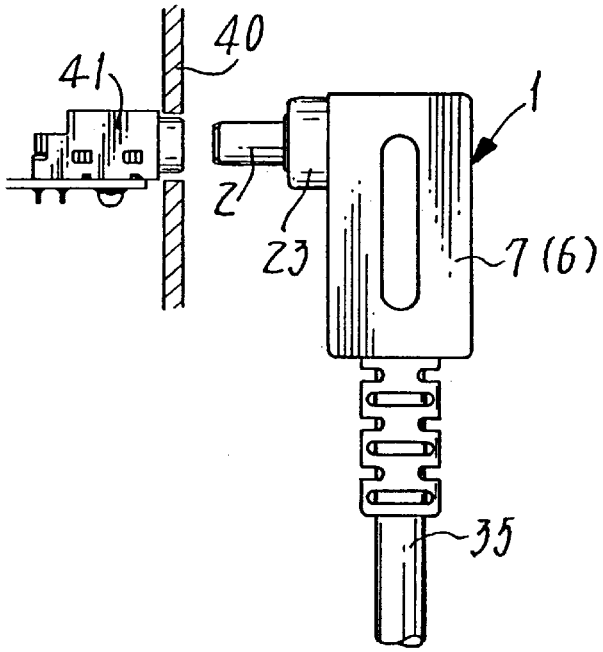
FIG. 4 is a front elevation of the finished plug connector thus provided herein and shown in use.
Figure 5:
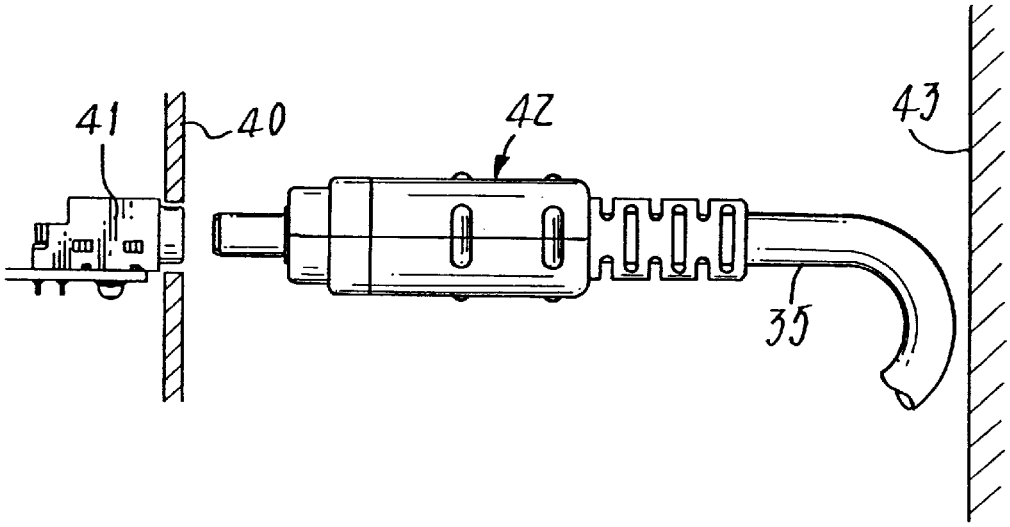
FIG.5 PRIOR ART
FIG. 5 is a front elevation of the prior art plug connector also shown in use, this connector being not classified in the angle type.
Figure 6:
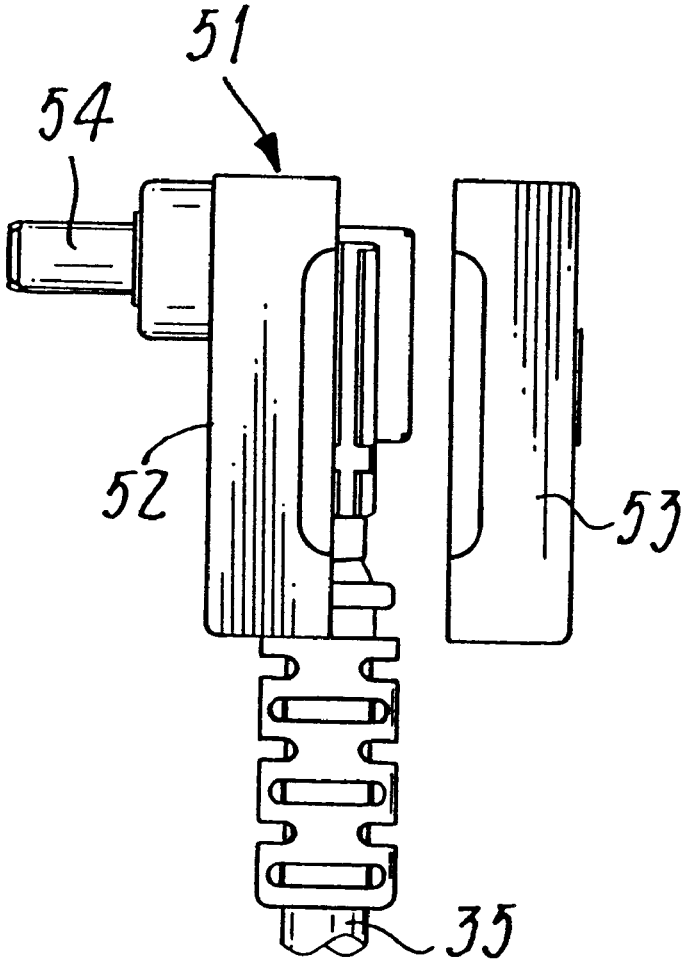
FIG.6 PRIOR ART
FIG. 6 is likewise a front elevation of the other prior art plug connector that is of the angle type.

FIG. 4 illustrates how this plug connector 1 is used, wherein the mating (socket type) connector 41 is mounted on an electronics apparatus 40. The distal end of the insulated body 2 will be pushed into the socket type connector 41 in a direction normal thereto. This operation towards and away from the mating connector can be done within a much narrower space than in the case of straight type connector 42 shown in FIG. 5. Freedom of swinging, bending or otherwise handling the signal transmission cable 35 is improved to a remarkable degree, thus facilitating use and treatment of the plug connector of the invention.

In summary, such a narrower space increasing the handling freedom do enable the connector to more easily match a variety of surrounding conditions. The insulated housing is split into halves by a plane coincident with the axes of said electric cable and insulated body that is to be inserted into the mating connector. The other feature that those halves of the housing are firmly fixed to each other by the three pairs of interlocking members fitted one in another will improve its resistance to torsion.

As set forth in the accompanying claims 2 and 3, the angle type shield provided herein and composed of the first and second metallic covers is of a much higher rigidity than in the prior art types. This feature will, in combination with such a stiffened housing, render the connector more resistant to a bending, distorting, withdrawing or any other stress imparted to the cable, while enhancing its shielding effect.

What is claimed is:

1. An angle type plug connector comprising:

an insulated body having an axis and an outer end portion designed for insertion into a mating connector;

the insulated body having an inner end region integral with guard lugs protruding perpendicularly to the axis;

a plurality of contacts fixed in the insulated body and each having at one of its opposed ends a finger to be engaged with a mating contact held in the mating connector;

each contact also having at the other end thereof a leg adjoined to one of a plurality of electric wires constituting a signal transmission cable that has a central line;

an angle type shield that consists of a first metallic cover and a second metallic cover, the first cover enclosing outer portions of the insulated body, and the second cover enclosing the legs of the contacts and bare end portions of the electric wires, the second cover extending generally at a right angle relative to the first cover, the first and second covers being engaged to prevent separation of the first and second covers in a first direction, wherein the first metallic cover of the angle type shield comprises a forward part enclosing substantially the entire transversely protrudIng insulating body, a middle part that is generally U-shaped in cross section to have side walls and continues from an inner end of the forward part and extends downwards perpendicularly thereto, and a collar portion continuing from a lower end of the middle part so as to grip a shielding layer of the signal transmission cable; and an insulated housing that encloses the angle type shield such that the insulated body and the cable protrude from the housing and are arranged perpendicularly to each other, wherein the insulated housing is split up into a first half and a second half symmetrical therewith so that these halves lie in parallel with a plane in which the axis of the insulated body and the central line of the cable are included, the split halves of the insulated housing respectively have inner faces, and wherein retention grooves are formed in the inner faces, the retention grooves securing therein the guard tugs of the insulated body, and each of the split halves has three side walls extending generally around the angle type shield and has three interlocking portions each formed in and along the respective side walls for interlocking with mating interlocking portions in the other split half to prevent the split halves from separating in a second direction perpendicular to the first direction.

2. An angle type plug connector as defined in claim 1, wherein the second metallic cover comprises a main part generally U-shaped in cross section having side walls and a rear wall, with the side walls engaging with the middle part of the first metallic cover so as to form a tubular part having a generally rectangular cross section, a top plate that is an upward extension of the rear wall, with the upward extension being bent forwards to be juxtaposed to an inner end of the forward part of the first cover to thereby close an upper end opening of the tubular part, whereby the U-shaped middle and main parts cooperate with the top plate to provide a box-shaped compartment enclosing the bare wire ends and the contact legs.

3. An angle type plug connector as defined in claim 2, wherein the side walls of the main U-shaped part partially overlap and engage the corresponding side walls of the middle U- shaped part so as to provide additional support for the tubular part.

4. An angle type plug connector as defined in claim 2, wherein both the split halves of the insulated housing have integral supports protruding transversely from upper ends of said halves, so that the retention grooves are disposed in the integral supports whereby the insulated body enclosed in the first metallic cover protrudes transversely from the integral supports.

5. An angle type plug connector as defined in claim 3, wherein both the split halves of the insulated housing have integral supports protruding transversely from upper ends of said halves, so that the retention grooves are disposed in the integral supports whereby the insulated body enclosed in the first metallic cover protrudes transversely from the integral supports.

6. An angle type plug connector as defined in claim 1, wherein both the split halves of the insulated housing have integral supports protruding transversely from upper ends of said halves, so that the retention grooves are disposed in the integral supports whereby the insulated body enclosed in the first metallic cover protrudes transversely from the integral supports.

7. An angle type plug connector as defined in claim 1, wherein the first direction is parallel to the axis of the insulated body and the second direction is perpendicular to the axis of the insulated body and perpendicular to the central line of the cable.

* * * * *